US008628373B2

(12) United States Patent
Payne

(10) Patent No.: US 8,628,373 B2
(45) Date of Patent: Jan. 14, 2014

(54) TOY VEHICLE PLAYSET

(75) Inventor: Julian R. Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 318 days.

(21) Appl. No.: 13/218,860

(22) Filed: Aug. 26, 2011

(65) Prior Publication Data

US 2012/0220183 A1 Aug. 30, 2012

Related U.S. Application Data

(60) Provisional application No. 61/377,444, filed on Aug. 26, 2010.

(51) Int. Cl.
*A63H 33/00* (2006.01)
*A63H 18/00* (2006.01)

(52) U.S. Cl.
USPC ..... 446/14; 446/444

(58) Field of Classification Search
USPC ..... 446/14, 267, 444–446; 104/53, 54; 238/10 A, 10 R
See application file for complete search history.

(56) References Cited

U.S. PATENT DOCUMENTS

| | | | |
|---|---|---|---|
| 3,456,596 | A | 7/1969 | Cooper |
| 3,621,602 | A | 11/1971 | Barcus |
| 3,994,492 | A | 11/1976 | Breslow |
| 4,132,032 | A | 1/1979 | Triska |
| 4,149,725 | A | 4/1979 | Todokoro |
| 4,224,761 | A | 9/1980 | Wakimura |
| 4,318,242 | A | 3/1982 | Pin-Houng |
| 4,324,065 | A | 4/1982 | Cooper |
| 4,519,789 | A | 5/1985 | Halford |
| 4,558,867 | A | 12/1985 | Hippely |
| 4,568,307 | A | 2/1986 | Gabler |
| 4,579,541 | A | 4/1986 | Kulesza et al. |
| 4,603,860 | A | 8/1986 | Wey |

(Continued)

FOREIGN PATENT DOCUMENTS

| | | | |
|---|---|---|---|
| GB | 2205255 | A | 12/1988 |
| JP | 11315277 | A | 11/1999 |

(Continued)

OTHER PUBLICATIONS

International Search Report mailed Apr. 10, 2012 for International Application Serial No. PCT/US2011/049315; International filing date Aug. 26, 2011.

(Continued)

*Primary Examiner* — Gene Kim
*Assistant Examiner* — Alyssa Hylinski
(74) *Attorney, Agent, or Firm* — Cantor Colburn LLP

(57) ABSTRACT

A toy vehicle playset having a toy vehicle and a vessel holding a body of water is provided. The toy vehicle traverses a gap above the vessel when a toy creature is in a first position and the toy vehicle is launched from one of first and second track segments into a gap. The toy vehicle is captured by the toy creature and subsequently lowered into the vessel and the body of water when the toy creature is in a second position and the toy vehicle is launched from one of the first and second track segments into the gap. A thermochromic paint on the toy vehicle changes from a first color to a second color when it is lowered into the body of water by the toy creature.

20 Claims, 9 Drawing Sheets

(56) References Cited

U.S. PATENT DOCUMENTS

| | | | | | |
|---|---|---|---|---|---|
| 4,708,685 | A | * | 11/1987 | Udagawa | 446/139 |
| 4,715,843 | A | | 12/1987 | Ostendorff | |
| 4,778,433 | A | | 10/1988 | McKay | |
| 4,917,643 | A | | 4/1990 | Hippely | |
| 4,936,574 | A | | 6/1990 | Lee | |
| 4,938,481 | A | | 7/1990 | Goldfarb | |
| 4,961,716 | A | * | 10/1990 | Hippely et al. | 446/75 |
| 5,085,607 | A | | 2/1992 | Shibahashi | |
| 5,163,863 | A | | 11/1992 | Goldfarb | |
| 5,234,216 | A | | 8/1993 | Ostendorff | |
| 5,267,888 | A | | 12/1993 | Hippely | |
| 5,316,513 | A | | 5/1994 | Nakagawa | |
| 5,334,078 | A | | 8/1994 | Hippely | |
| 5,478,269 | A | | 12/1995 | Wolfram | |
| 5,503,583 | A | | 4/1996 | Hippely | |
| 5,586,923 | A | * | 12/1996 | Hippely et al. | 446/14 |
| 5,609,340 | A | | 3/1997 | Chuang | |
| 5,609,341 | A | | 3/1997 | Chuang | |
| 5,643,040 | A | | 7/1997 | Hippely | |
| 5,702,108 | A | | 12/1997 | Todokoro | |
| 5,743,185 | A | * | 4/1998 | Hippely et al. | 101/327 |
| 5,871,385 | A | | 2/1999 | Hippely | |
| 6,164,653 | A | | 12/2000 | Chuang | |
| 6,216,600 | B1 | | 4/2001 | Verret | |
| 6,346,024 | B1 | | 2/2002 | Engel | |
| 6,358,112 | B1 | | 3/2002 | Lambert et al. | |
| 6,364,771 | B1 | | 4/2002 | Lee | |
| 6,468,088 | B1 | | 10/2002 | Fujita | |
| 6,585,555 | B2 | | 7/2003 | Wong | |
| 7,628,674 | B2 | * | 12/2009 | Nuttall et al. | 446/444 |
| 7,690,964 | B2 | * | 4/2010 | Nuttall et al. | 446/444 |
| 7,753,753 | B2 | * | 7/2010 | Payne et al. | 446/75 |
| 8,182,308 | B2 | * | 5/2012 | Payne | 446/267 |
| 8,267,738 | B2 | * | 9/2012 | Nuttall | 446/444 |
| 2003/0087580 | A1 | | 5/2003 | Shibahashi | |
| 2006/0286896 | A1 | | 12/2006 | Bedford | |
| 2007/0259593 | A1 | | 11/2007 | Imai | |
| 2008/0020675 | A1 | | 1/2008 | Ostendorff | |

FOREIGN PATENT DOCUMENTS

| | | | |
|---|---|---|---|
| JP | 2000140455 | A | 5/2000 |
| JP | 2001149666 | A | 6/2001 |
| WO | 8908486 | A1 | 9/1989 |

OTHER PUBLICATIONS

Written Opinion of the International Searching Authority mailed Apr. 10, 2012 for International Application Serial No. PCT/US2011/049315; International filing date Aug. 26, 2011.

* cited by examiner

TOY VEHICLE PLAYSET

CROSS REFERENCE TO RELATED APPLICATIONS

The present application claims priority to U.S. Provisional Application Ser. No. 61/377,444 filed on Aug. 26, 2010 entitled "Toy Vehicle Playset" which is incorporated herein by reference in its entirety.

BACKGROUND

This application relates to a toy vehicle playset, and in particular to a toy vehicle playset having a movable object that captures another object and immerses the captured object into a body of water to change a color of the captured object.

Toy vehicle playsets are an extremely popular category of toys for players. Further, creature-based toys and water-based games are fun to play and help enhance the imaginary play of the player. Also, players are fascinated with toy vehicles that can change colors.

Accordingly, it is desirable to provide a toy playset that provides enhanced play features.

SUMMARY OF THE INVENTION

A toy vehicle playset in accordance with an exemplary embodiment is provided. The toy vehicle playset includes a vessel configured to hold a body of water therein. The toy vehicle playset further includes a toy creature disposed in the vessel. The toy creature has a head portion with an upper jaw portion and a lower jaw portion. The lower jaw portion is pivotally coupled to the toy creature for movement between an open position and a closed position with respect to the upper jaw portion. The toy creature is configured to reciprocally move between a first position and a second position such that the toy creature moves out of and into the vessel and wherein the lower jaw portion moves towards the upper jaw portion when the toy creature is moving toward the first position and the lower jaw portion moves away from the upper jaw portion when the toy creature is moving towards the second position. The toy vehicle playset further includes first and second track segments disposed proximate to the vessel such that a gap is formed between the first and second track segments and across the vessel, wherein the toy creature is located in the gap when the toy creature is in the second position. The toy vehicle playset further includes a toy vehicle having a thermochromic paint thereon that is configured to travel along the first and second track segments. The toy vehicle traverses the gap when the toy creature is in the first position and the toy vehicle is launched from one of the first and second track segments into the gap. The toy vehicle is captured by the toy creature when the toy creature is in the second position and the toy vehicle is launched from one of the first and second track segments into the gap. Further, the thermochromic paint on the toy vehicle changes from a first color to a second color when the toy vehicle is contacted by water.

In another embodiment, a method of changing the color of an object having a thermochromic paint disposed thereon is provided. The method including the steps of launching the object from a first track segment across a gap towards a second track segment, the second track segment being spaced from the first track segment; capturing the object when it is in the gap by a toy creature; and lowering the captured object and the toy creature into a body of water disposed below the gap, wherein the thermochromic paint disposed on the object changes from a first color to a second color when the object is immersed in the body of water.

In still another embodiment, a toy vehicle playset is provided, the toy vehicle playset having: a vessel configured to hold a body of water therein; first and second track segments disposed proximate to the vessel such that a gap is formed between the first and second track segments and across the vessel; a toy creature disposed in the vessel, wherein the toy creature is configured to move between a first position and a second position such that the toy creature moves out of and into the vessel and wherein the a portion of the toy creature is disposed in the gap when the toy creature is in the second position; a toy vehicle having a thermochromic paint thereon that is configured to travel along the first and second track segments; and wherein the toy vehicle traverses the gap when the toy creature is in the first position and the toy vehicle is launched from one of the first and second track segments into the gap, and wherein the toy vehicle is captured by the toy creature when the toy creature is in the second position when the toy vehicle is launched from one of the first and second track segments into the gap, and wherein the thermochromic paint on the toy vehicle changes from a first color to a second color when the toy vehicle is lowered into the body of water by the toy creature.

BRIEF DESCRIPTION OF THE DRAWINGS

Other features, advantages and details appear, by way of example only, in the following description of embodiments, the description referring to the drawings in which.

DETAILED DESCRIPTION

Figures 1, 2:
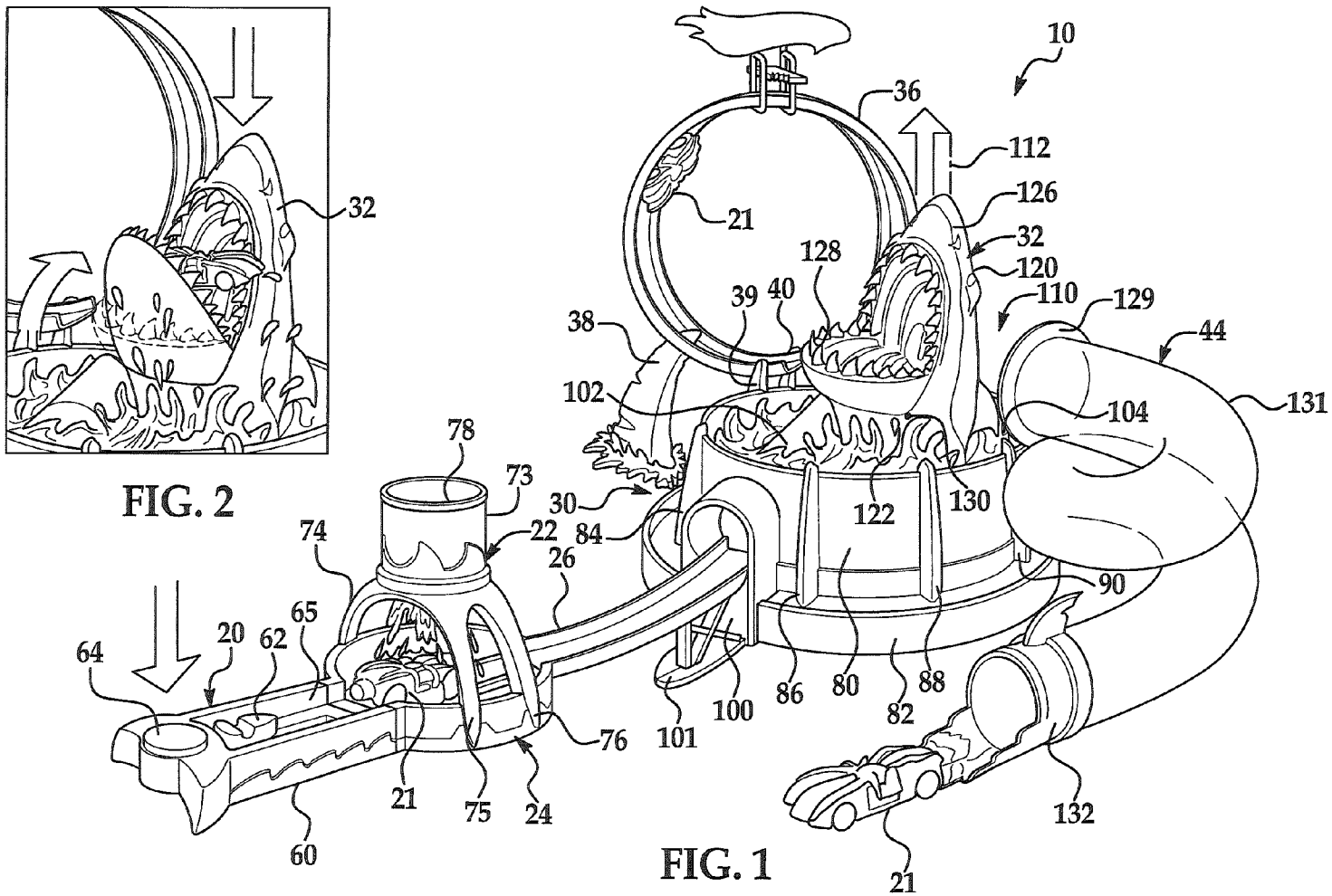
FIG. 1 is a perspective view of a toy vehicle playset in accordance with an exemplary embodiment.
FIG. 2 is an enlarged perspective view of a toy creature utilized in the toy vehicle playset of FIG. 1.
Figure 4:
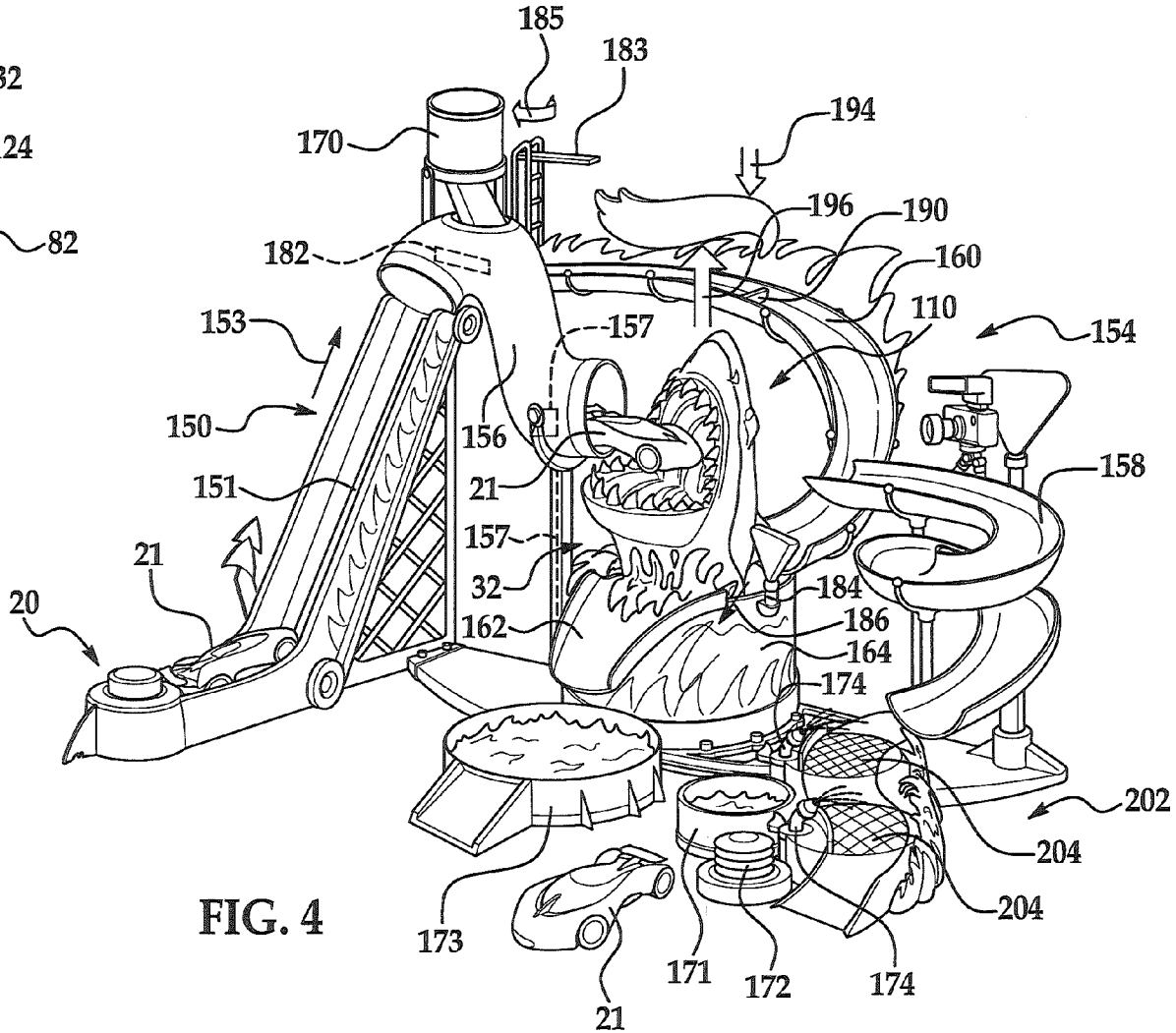
FIG. 4 is a perspective view of an alternative embodiment of the present invention.

Reference is made to the following U.S. Pat. No. 5,586,923 the contents of which are incorporated herein by reference thereto. Referring now to the FIGS, the contents each of which are incorporated herein by reference thereto, exemplary embodiments of the present invention are illustrated. Referring now to FIGS. 1 and 2, a toy vehicle playset 10 in accordance with an exemplary embodiment of the present invention is illustrated. The vehicle playset 10 has a grabbing mechanism 32 that in one embodiment that is shaped as a toy shark, toy piranha, or other toy creature that captures an object 21 and at least partially immerses the object 21 into a body of water 104 to change a color of the object 21. In various embodiments of the present invention toy creature 32 can be any configuration of a creature wherein the jaws of the same are configured to grasp a toy vehicle passing through the jaws. In one embodiment, the toy creature is a toy shark. In another embodiment, the toy creature is a piranha. In still another embodiment, the playset is configured to have no grabbing mechanism. In one embodiment, the object 21 is configured to resemble a toy vehicle. As illustrated, the toy vehicle playset 10 includes a toy vehicle launcher 20, the object or toy vehicle 21, a water tower 22, track segments 24, 26, a vessel or tank 30, the toy shark 32, a track segment 36, support portions 38, 39, 40, and a tubular track segment 44.

The toy vehicle launcher 20 is provided to launch the object or toy vehicle 21 therefrom such that it traverses along at least one of the track segments. In one non-limiting configuration, the toy vehicle launcher 20 includes a plastic housing 60, a spring-loaded pusher 62, a trigger latch 64, and a staging area 65. The housing 60 supports the movable spring-loaded pusher 62 and a trigger latch 64. The movable spring-loaded pusher 62 urges the toy vehicle 21 in a forward direction when the trigger latch 64 is activated. The staging area 65 is configured to receive the toy vehicle 21 in a pre-launch position. Further, the toy vehicle launcher 20 is coupled to the track segment 24. In one non-limiting exemplary embodiment of the present invention, the track segment 24 and other components are manufactured from easily molded materials such as plastic.

The object or toy vehicle 21 is provided to traverse a raceway or pathway defined by the track segments and a tubular portion of the vessel 30. The toy vehicle 21 has at least certain portions coated or painted with color change or thermochromic paint. The toy vehicle 21 is configured to change from a first color to a second color, or to change from the second color to the first color, depending on a temperature of the paint. Further, the second color is a different color than the first color. In particular, the thermochromic paint has the first color at a first temperature of the thermochromic paint, and the second color at a second temperature of the thermochromic paint. For example, the thermochromic paint changes from the first color to the second color if a temperature of the paint is decreased when the toy vehicle 21 has water applied thereto. In one exemplary embodiment, the first color is a yellow color and the second color is a red color. Of course in alternative embodiments the first and second colors could be other colors.

The water tower 22 is provided to disperse water on the toy vehicle 21 as the toy vehicle 21 traverses the track segment 24 or anyone of the track segments. The water tower 22 includes a tank portion 73 for holding water 78 therein, and leg supports 74, 75 and 76. A bottom surface of the tank portion 73 includes a plurality of apertures (not shown) extending therethrough. The leg supports 74, 75 and 76 are coupled to the bottom surface of the tank portion 73 and further coupled to outer portions of the track segment 24. Thus, the leg supports 74, 75 and 76 elevate the tank portion 73 over a portion of the track segment 24. Water in the tank portion 73 flows through the apertures onto the toy vehicle 21 traversing the track segment 24 such that at least a portion of the toy vehicle 21 changes from a first color to a second color, or from the second color to the first color.

The track segment 26 extends from the track segment 24 to an inlet portion 100 of the vessel 30. The tank or vessel 30 is provided to hold the toy shark 32 and the body of water 104 therein. As illustrated, the vessel 30 includes a tubular shaped side wall 80, a base 82, retaining members 84, 86, 88 and 90, an inlet portion 100, a support portion 101, and a tubular track segment 102. The tubular shaped side wall 80 is coupled to the base 82 which is substantially circular shaped or course, other configuration are contemplated. In one exemplary embodiment, the wall 80 is constructed of a substantially translucent plastic such that the toy shark disposed therein may be at least partially immersed in water and may also be viewed from the exterior of the vessel. The wall 80 and the base 82 define an interior region for holding the water 104 and at least a portion of the toy shark 32 therein. The retaining members 84, 86, 88 and 90 extend from a top surface of the base 82 alongside an outer surface of the tubular shaped side wall 80 to support the wall 80. The inlet portion 100 defines an opening for receiving an end of the track segment 26 therein. The support portion 101 is disposed proximate to the inlet portion 100 and supports an end of the track segment 26 such that the track segment 26 communicates with the inlet portion 100. The tubular track segment 102 extends from the inlet portion 100 across an interior region of the tank 30 to an outlet portion (not shown) having a similar configuration as the inlet portion 100. Thus, water within the vessel 30 does not enter the tubular track segment 102.

Figure 3:
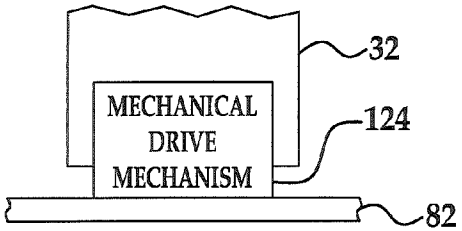
FIG. 3 is a block diagram of a mechanical drive mechanism utilized in the toy vehicle playset of FIG. 1.
Figure 5B:
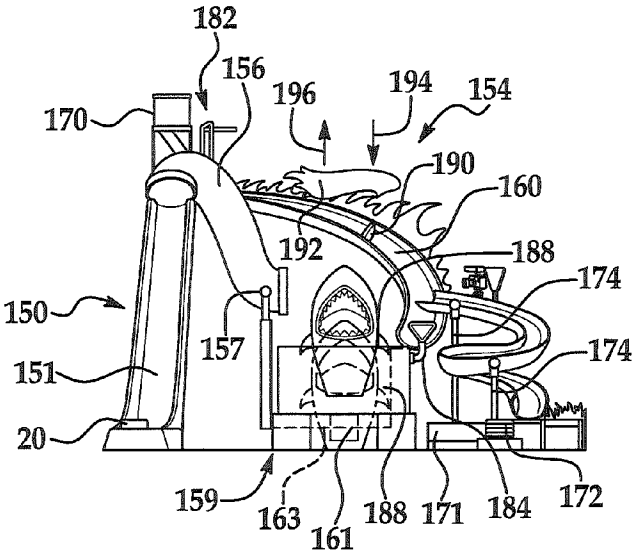
FIG. 5B is a side view of a schematic illustration of the FIG. 4 embodiment.

Referring to FIGS. 1 and 3, the toy shark 32 is provided to capture the toy vehicle 21 in jaw portions of the toy shark 32 when the toy shark 32 is at a second position (e.g., fully upward position) in the gap 110 and the toy vehicle is traversing a portion of the gap 110. The toy shark 32 is disposed at least partially in an interior region defined by the vessel 30 and is at least partially surrounded by the body of water 104. The toy shark 32 has a longitudinal axis 112 that extends generally vertically relative to the base 82 of the vessel 30. In one exemplary embodiment, the toy shark 32 is constructed of plastic and includes a head portion 120, a body portion 122, and a mechanical drive mechanism 124. Further, the head portion 120 is coupled to the body portion 122. The body portion 122 is operably coupled to the mechanical drive mechanism 124. The head portion 120 of the toy shark 32 has an upper jaw portion 126, a lower jaw portion 128, and a pivot point 130. The lower jaw portion 128 is pivotally coupled to the pivot point 130 and pivots about the pivot point 130 between an open position and a closed position with respect to the upper jaw portion 126. The lower jaw portion 128 is further operably coupled to the mechanical drive mechanism 124.

The mechanical drive mechanism 124 is provided to reciprocally move the toy shark 32 downwardly and upwardly along the longitudinal axis 112 relative to the base 82 between a first position (e.g., fully downward position) and a second position (e.g., fully upward position). In particular, the mechanism 124 reciprocally moves the toy shark 32 between the first position and the second position such that the toy shark 32 moves into and out of the vessel 30, respectively. The toy shark 32 is at least partially immersed in the body of water 104 when the toy shark 32 is in the first position. In one non-limiting embodiment, the toy shark 32 is completely immersed in the body of water 104 when the toy shark 32 is in the first position. Further, the lower jaw portion 128 and the upper jaw portion 126 each extend out of the body of water 104 when the toy shark 32 is in the second position. The mechanical drive mechanism 124 is operably coupled between the base 82 and the body portion 122 of the toy shark 32. The mechanical drive mechanism 124 may be further operably coupled to the lower jaw portion 128 such that the lower jaw portion 128 pivots toward the upper jaw portion 126 when the toy shark 32 is moving toward the first position and the lower jaw portion 128 pivots away from the upper jaw portion 126 when the toy shark 32 is moving towards the second position. In one embodiment, the lower jaw portion 128 pivots under the force of gravity. In one exemplary embodiment, the mechanical drive mechanism 124 is a spring-loaded mechanical drive mechanism that may include a latch mechanism to release the drive mechanism and allow the toy shark to move to the second position. Of course, other types of drive mechanisms are contemplated herein. For example, one non-limiting alternative mechanical drive mechanism is a battery operated motor mechanism.

As illustrated, the tubular track segment 44 is disposed proximate to the edge of the vessel 30 opposite to the track segment 36. In one non-limiting configuration, the track segment 36 is configured to have a loop-to-loop portion. Additionally and in one embodiment, the tubular track segment 44 is constructed of a translucent plastic such that the vehicles travelling therethrough may be viewed from the exterior of the tubular track segment. The tubular track segment 44 includes an inlet portion 129, a body portion, and an outlet portion 132. As illustrated, a gap 110 is formed between an end of the track segment 36 proximate to the vessel 30 and the inlet portion 129 of the tubular track segment 44.

In a first play scenario, the toy vehicle 21 is launched from the toy vehicle launcher 20 along the track segments 24, 26. When traversing the track segment 24, water is dispersed from the water tower 22 and contacts the toy vehicle 12, and at least a portion of the thermochromic paint on the toy vehicle 12 changes from a first color to a second color, or alternatively from the second color to the first color. From the track segment 26, the toy vehicle 21 traverses the tubular track segment 102 and the track segment 36. Thereafter, the toy vehicle 21 traverses across a portion of the gap 110 toward the upper and lower jaw portions 126, 128 of the toy shark 32 at the second position. When the upper and lower jaw portions 126, 128 of the toy shark 32 capture the toy vehicle 21 at the second position. In one embodiment, the toy shark 32 subsequently lowers the toy vehicle 21 along the longitudinal axis 112 to the first position in the body of water 104, and the thermochromic paint 70 on the toy vehicle 21 changes from the first color to the second color, or alternatively from the second color to the first color. Thereafter, the toy shark 32 moves from the first position upwardly along the longitudinal axis 112 and the toy vehicle 21 having the second color is moved out of the water 104.

In an alternative play scenario, the toy vehicle 21 is launched from the toy vehicle launcher 20 along the track segments 24, 26. When traversing the track segment 24, water is dispersed from the water tower 22 and contacts the toy vehicle 12, and at least a portion of the thermochromic paint on the toy vehicle 21 changes from a first color to a second color, or alternatively from the second color to the first color. From the track segment 26, the toy vehicle 21 traverses the tubular track segment 102 and the track segment 36. Thereafter, the toy vehicle 21 traverses the gap 110 when the toy shark 32 is in the first position and the toy vehicle 20 is received in the inlet portion 129 of the tubular track segment 44. Thereafter, the toy vehicle 20 traverses a body portion 131 of the tubular track segment 44 and exits an outlet portion 132 of the tubular track segment 44.

Referring now to FIGS. 4-7 alternative exemplary embodiments of the present invention are illustrated. Here the play set 10 includes a creature 32 that is shaped as a shark (FIGS. 4-7) or alternatively, the creature is shaped as a piranha in FIG. 8. In the embodiment of at least FIGS. 4-7, the creature or shark grabs toy vehicles as they attempt to traverse the gap 110 between a first track segment and a second track segment. Of course, other configurations are contemplated for creature or item 32 to be within the scope of exemplary embodiments of the present invention. For example, creature 32 can be of any configuration while still providing a toy vehicle grabbing function.

In one play configuration, the toy vehicles are launched via launcher 20 up a structure 150 and then traverse down either a first path 152 or a second path 154. In one embodiment, the first structure is configured to resemble a lift or elevator wherein a continuous loop 151 is rotated in the direction of arrows 153 such that the toy vehicle is pulled up structure 150. Alternatively, the vehicles or objects are just launched up structure 150 by the launcher 20. The first path has a first segment 156 and a second segment 158 while the second path also has a first segment 160 and a second segment 162 each being disposed on either side of a vessel of water 164 disposed in a gap 110.

As in the previous embodiments, the shark or creature is configured to move up and down and if the shark or creature captures the toy vehicle when the vehicle crosses the gap the vehicle is immersed in the water and the thermochromic paint changes color. In the illustrated embodiments, the first path or second path or both are configured to resemble a water slide. For example playset 10 is configured to resemble a water park.

Besides the vessel of water 164 additional water vessels 170, 171 and 173 are located around the play set and each of these vessels can be supplied with different temperature water to provide a different color change to the thermochromic paint on the toy vehicle 21 such that it changes from a first color to a second color, or alternatively from the second color to the first color depending on the temperature of the car and the water being applied. In one embodiment, a manual pumping mechanism 172 and nozzles 174 may be provided to spray water on the cars from vessel 171 as they pass through the play set. Similar to the previous embodiment, vessel 170 is configured to direct water onto the first segment of the first path. While vessel 173 provides an area a vehicle can land in as they exit segment 162.

Figure 6B:
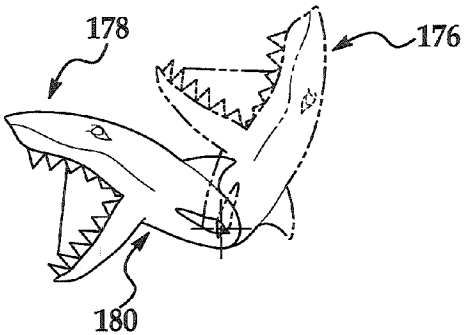
FIGS. 6A and 6B illustrate movement of the creature mechanism of an embodiment of the present invention.
Figure 5A:
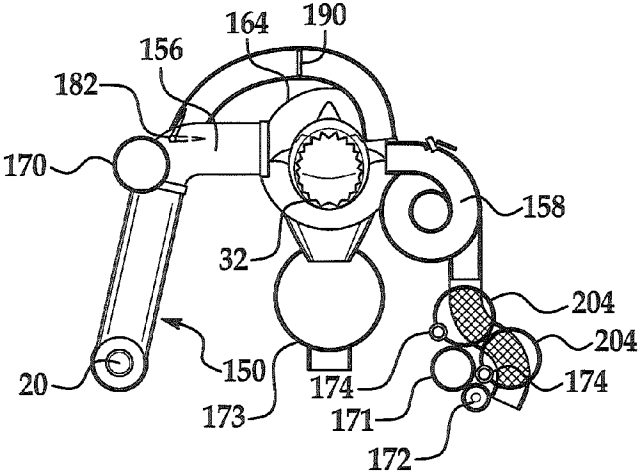
FIG. 5A is a top view of a schematic illustration of the FIG. 4 embodiment.
Figure 6A:
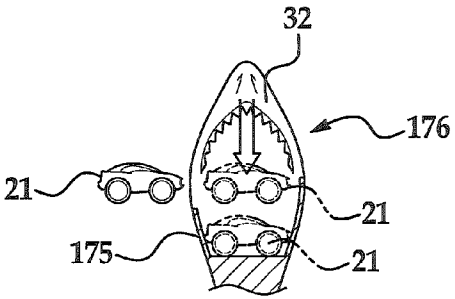

In one embodiment and referring at least to FIGS. 4-8 the creature 32 captures the toy vehicle 21 when the creature is in the first position 176 illustrated at least in FIGS. 6A and 6B and when the creature or shark is moved forward in the direction of arrow 178 to a second position 180 the captured car is released. Still further, the creature may have an up and down movement similar to that described in FIGS. 1-3. In another embodiment, the creature may move up randomly or upon every predetermined launch down segment 156 wherein a switch 157 is coupled to a release mechanism 159 of the creature.

In another embodiment, the creature's mouth has a water tank 175 that catches all cars completely when the shark springs up. When defeated the shark pivots forward and car and water pours into front water tank.

In one embodiment and when the creature captures a car, another car can be launched to try and rescue the capture vehicle. Here a track diverter 182 is provided to redirect a car launched from the launcher to the second path 154 instead of the first path. In order to move the track diverter between a first position (first path selected) and a second position (second path selected) a movable lever 183 is manipulated in the directions of arrows 185. When diverted down the second path the vehicle will travel down segment 160 and contact a release mechanism 184 coupled to the creature such that movement of the release mechanism in the direction of arrow 186 will cause the creature to move from the first position 176 to the second position 180 and the captured car will be released down segment 162. Alternatively or in conjunction with mechanism 184 a fin 188 of the creature can be contacted by the vehicle to also move the creature from the first position to the second position.

In order to reset the creature it is returned to the vertical configuration the creature is manually pushed downward to engage a spring tab 161. The spring tab 161 is coupled to engage a compressed spring 163 to hold the creature in place until the next activation when the trigger 157 of the release mechanism 159 is actuated. Accordingly and in one embodiment, a user simply pushes down the creature vertically to manually reset the release mechanism.

In another embodiment, a car or object barrier 190 is provided. Barrier is configured to move between a blocking and unblocking position in segment 160 wherein barrier 190 is moved downward when a sign or lever 192 is pushed downward in the direction of arrow 194. The sign or lever can be kept in the downward position so that cars can pass straight through segment 160. Alternatively, the sign or lever can be spring biased upward in the direction of arrow 196. In various embodiments, sign or lever 192 and barrier 190 may be used to aim cars at the release mechanism 184 of the creature. Alternatively, the lever and barrier may be used for simple variations in play.

Figure 7:
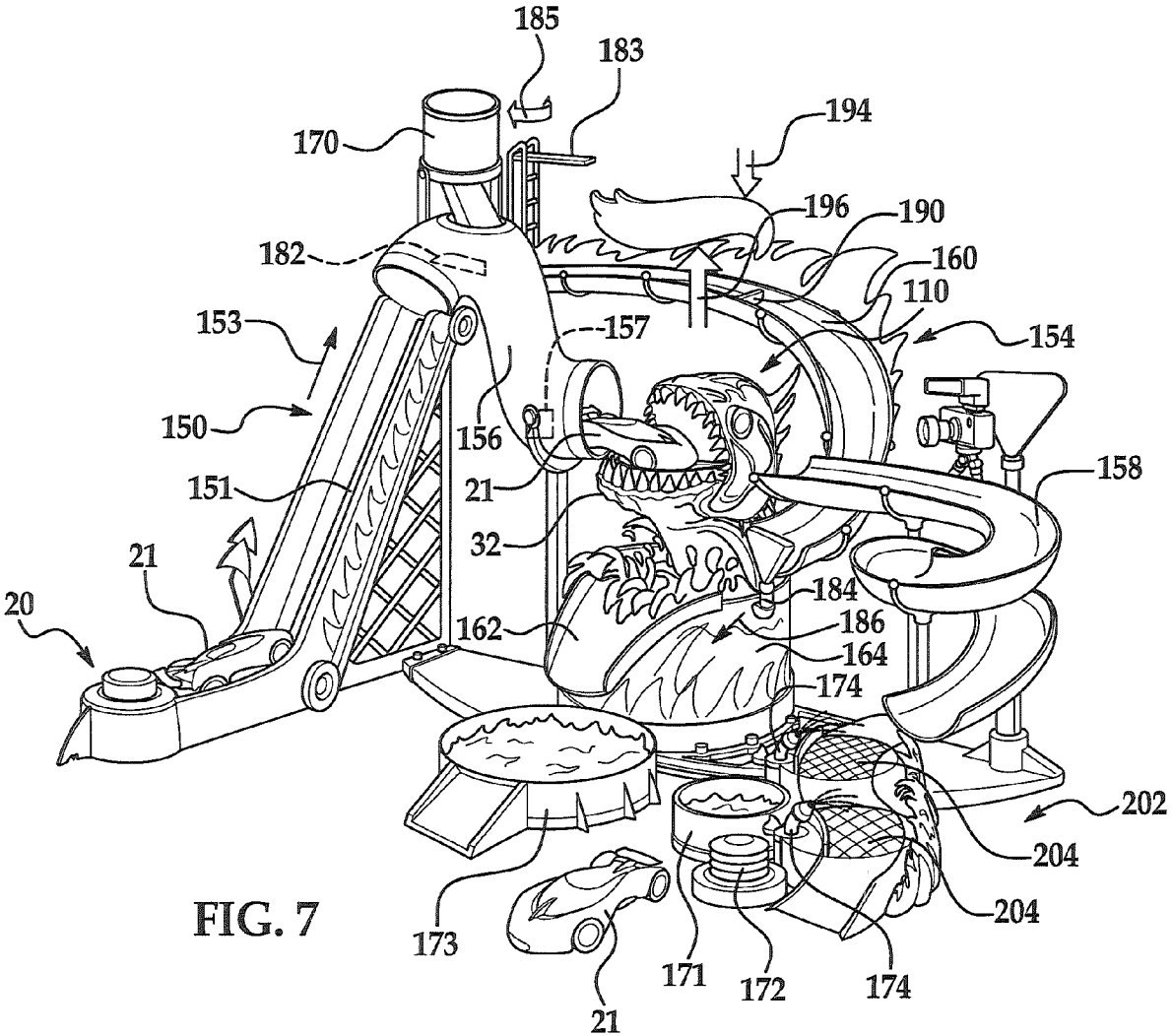
FIG. 7 is a perspective view of another alternative embodiment of the present invention.

FIG. 7 illustrates an alternative exemplary embodiment, wherein creature 32 is configured to resemble a piranha instead of a shark. Of course, numerous other creatures are contemplated to be within the scope of exemplary embodiments of the present invention.

In this embodiment a trigger can be coupled to the tank 170 such that it releases water as the toy vehicle passes by. Similar to the other embodiments, a splash zone 202 may be provided wherein a pump 172 pumps water from vessel 171 to a pair of nozzles 174. In an embodiment, the nozzles may be rotatably mounted so they can redirect water being pumped therethrough. In one implementation, the sprayed water drops through grids 200 and is redirected to vessel 171.

Figure 8:
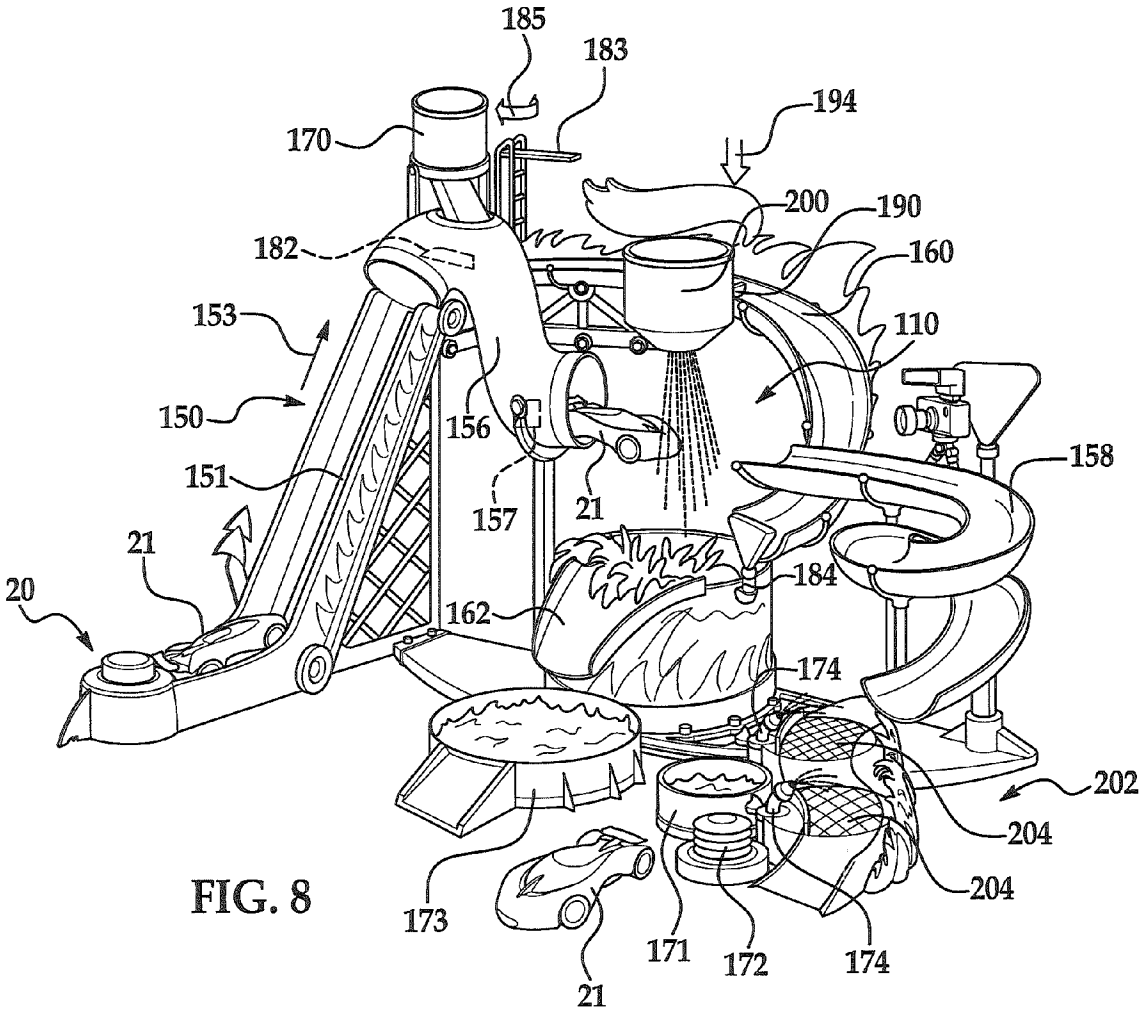
FIG. 8 is a perspective view of still another alternative embodiment of the present invention; and, FIGS. 9-11 illustrate features of exemplary embodiments of the present invention.
Figure 9A:
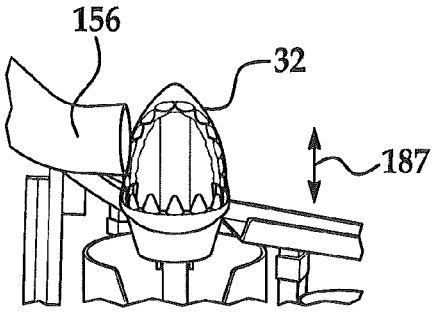
Figure 9B:
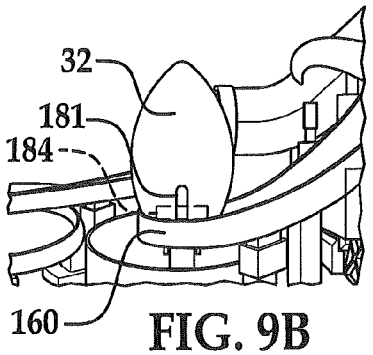
Figure 9C:
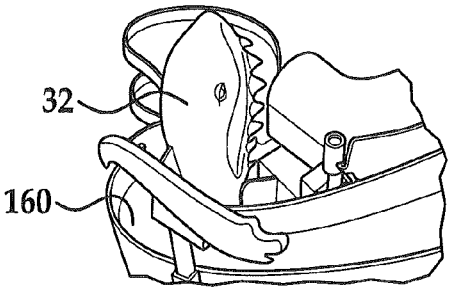
Figure 9D:
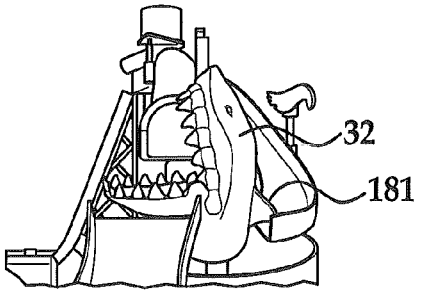
Figure 9E:
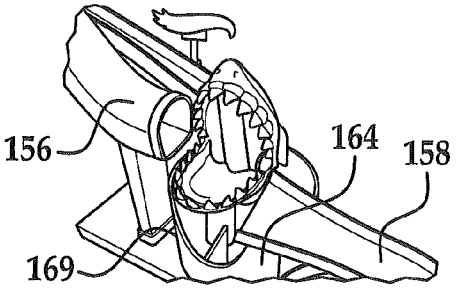
Figure 9F:
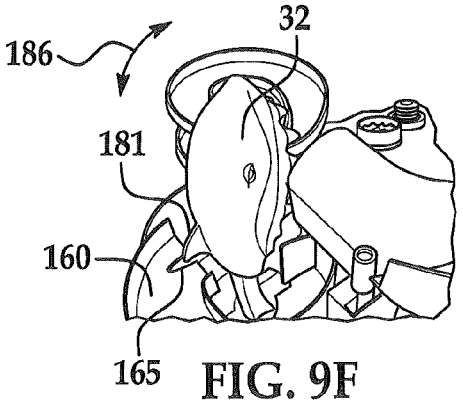
Figure 9G:
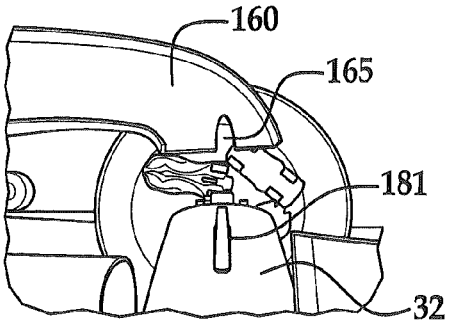
Figure 9H:
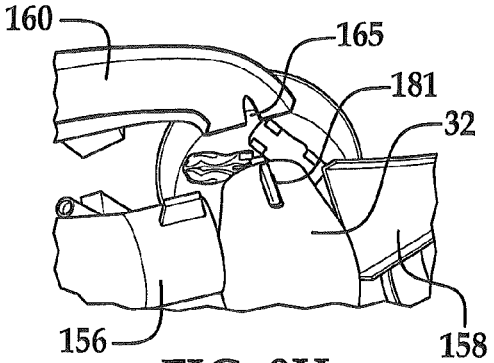

FIG. 8 illustrates an alternative exemplary embodiment, wherein the play set further comprises a water tank 200 that disperses water on a vehicle as it is traversing gap 110. In this embodiment, the water tank may be used in conjunction with creature 32 of in lieu of creature 32. As illustrated, many of the features of the play set of FIGS. 4-8 are included here. Of course, numerous configurations are contemplated and exemplary embodiments of the present invention are not specifically limited to the configurations illustrated in the attached FIGS. In this embodiment, the water from the water tank 200 gives the vehicle the instant color change and the diverter 182 and barrier 190 may be employed during vehicle movement down the first and second paths.

In this embodiment a trigger can be coupled to the tanks 170, 200 such that they release water as the toy vehicle passes by. Similar to the other embodiments, a splash zone 202 may be provided wherein a pump 172 pumps water from vessel 171 to a pair of nozzles 174. In an embodiment, the nozzles may be rotatably mounted so they can redirect water being pumped therethrough. In one implementation, the sprayed water drops through grids 204 and is redirected to vessel 171.

Figure 10A:
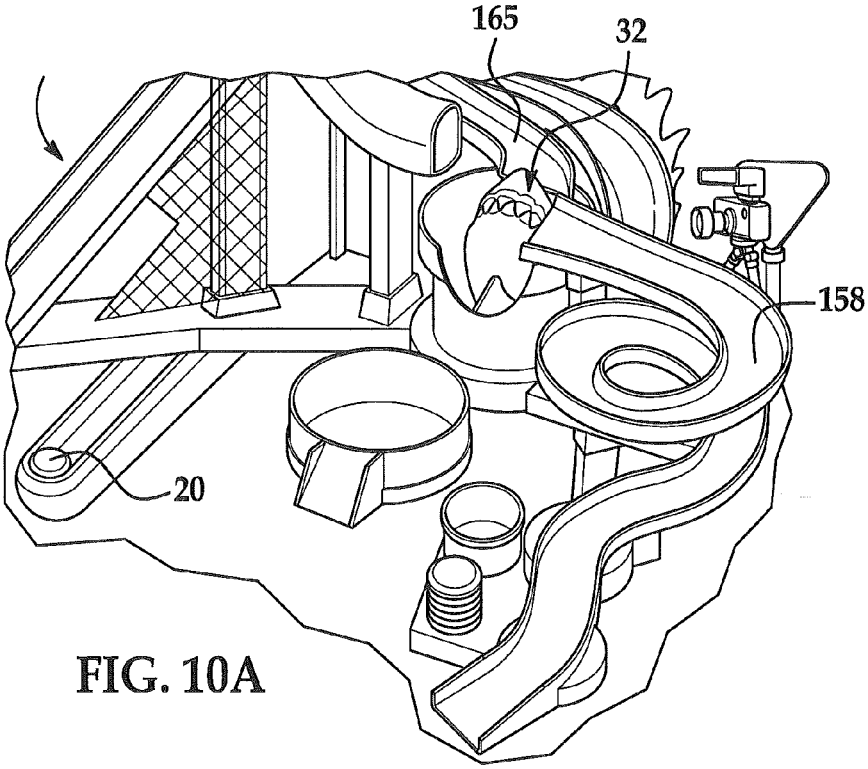
Figure 10B:
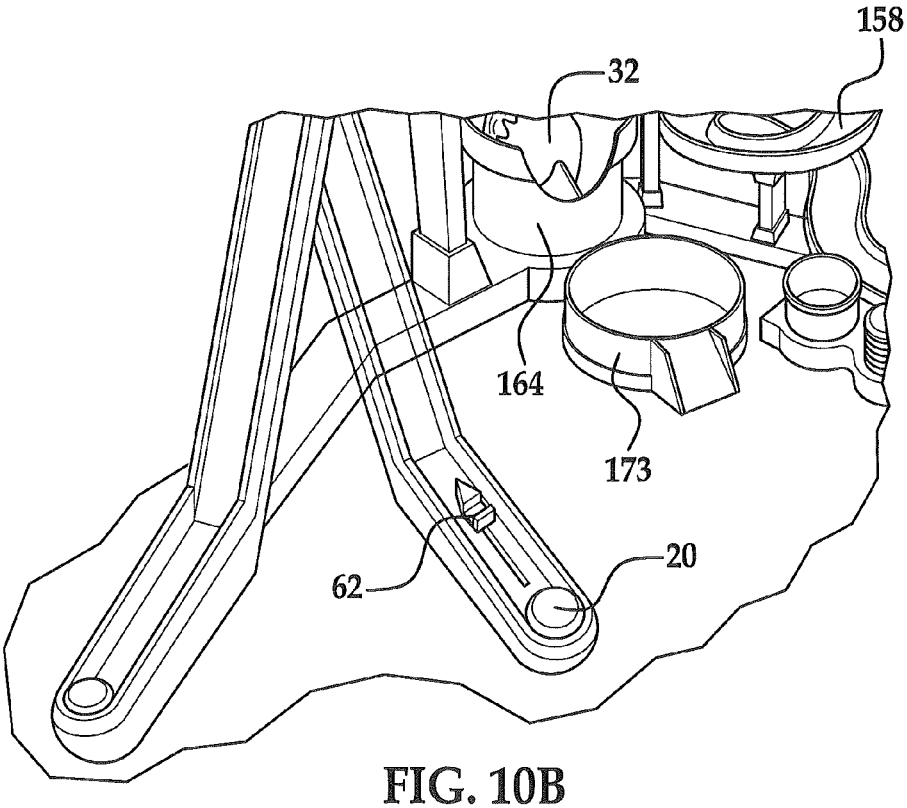
Figure 10C:
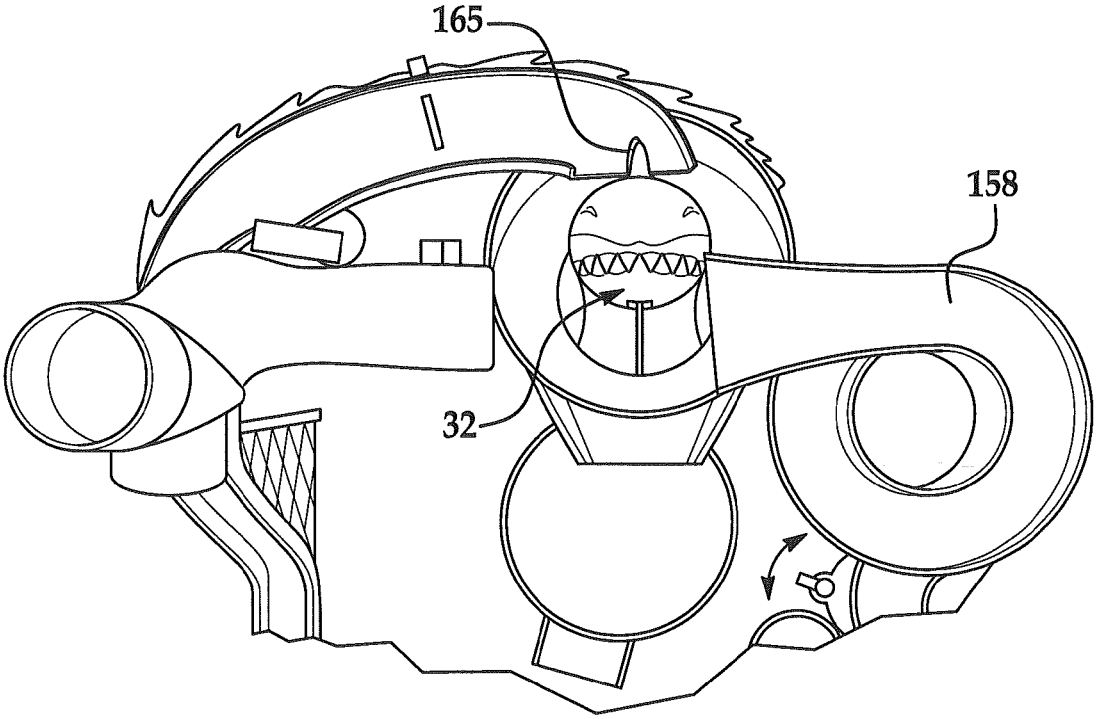
Figure 11A:
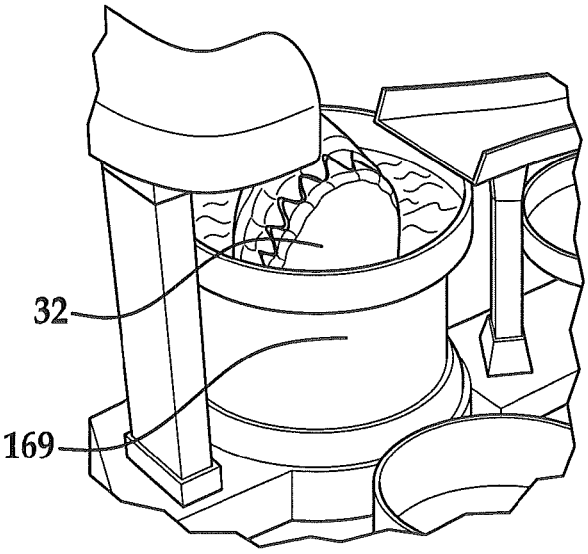
Figure 11B:
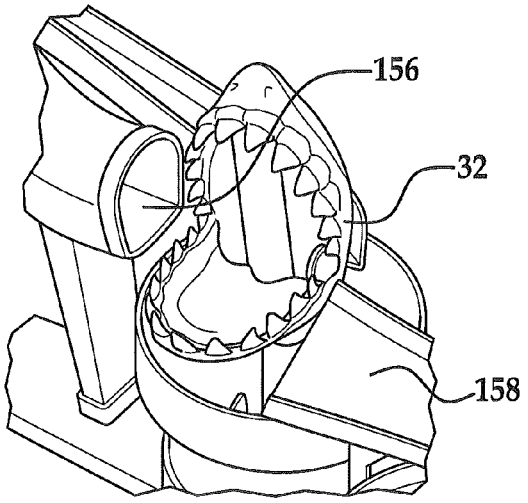
Figure 11C:
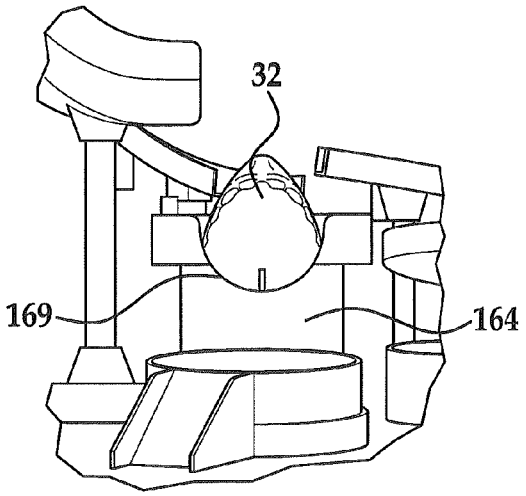
Figure 11D:
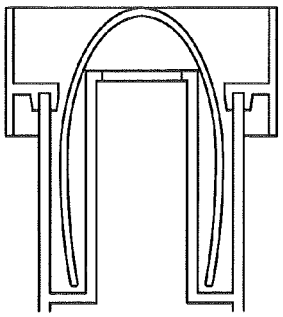

FIGS. 9-11 provide additional views of exemplary embodiments of the present invention. In one alternative embodiment, and as illustrated at least in FIGS. 9A-9H, a trigger 181 of the release mechanism 184 is the shark's fin such that when a toy vehicle or object is diverted down the second path the vehicle will travel down segment 160 and contact the trigger 181 to depress it into the creature such that release mechanism 184 coupled to the creature will be actuated. The actuation of the release mechanism causes movement of the creature in the direction of arrow 186 that will cause the creature to move from the first position to the second position and the captured car will be released down segment 162. In addition and in another alternative, track segment 160 is configured to have a slotted opening 165 to receive the trigger/fin therein.

Accordingly, the creature may be capable of movement upwards and downwards in the direction of arrows 187 as well as forwards and backwards and any combinations thereof or only up and down or only forward and backwards. Movement of the creature up and down and forward and back is achieved in one non-limiting embodiment by a compressed spring or springs that is/are held in compression by a catch of the release mechanism or mechanisms wherein movement of the associated trigger moves the catch and releases the energy of the compressed spring to provide the desired movement. Thereafter, manual resetting of the mechanism is achieved by pushing or moving the creature back such that the associated springs are compressed and engaged by the associated catch. In one embodiment upward and downward movement may be random or caused by actuation of a trigger in segment 156. Alternatively only upward movement is caused by actuation of the trigger in segment 156. In addition, at least forward and alternatively backward movement is caused by actuation of a trigger (e.g., fin 181 of mechanism 184) by an object or vehicle traveling down segment 160. Of course, numerous configurations and variations are contemplated to be within the scope of exemplary embodiments of the present invention.

Still further and when the creature is disposed down in the vessel its lower and upper jaws are held together and then as the creature moves upwards into the gap at least the lower jaw moves with respect to the upper jaw and the mouth is opened to capture an object or vehicle traversing through the gap. In addition and in yet another alternative embodiment, vessel 164 is configured to have an opening 169 to allow for the forward movement of the creature such that captured vehicles or objects can be released.

As described above, the toy vehicle playsets disclosed herein provides substantial advantages over other toy playsets. In particular, the toy vehicle playset allows a user to be entertained by providing a toy vehicle that is captured by the toy shark and subsequently lowered into a body of water in a vessel. Further, the user is entertained by thermochromic paint on the toy vehicle changing from a first color to a second color when the toy vehicle is lowered into the body of water by the toy shark. Furthermore and by varying the temperature of the water in the water tower and/or the vessel, the object or car will be capable of changing into a variety of colors.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy vehicle playset, comprising:

a vessel configured to hold a body of water therein;

a toy creature disposed in the vessel, the toy creature having a head portion with an upper jaw portion and a lower jaw portion, the lower jaw portion being pivotally coupled to the toy creature for movement between an open position and a closed position with respect to the upper jaw portion, wherein the toy creature is configured to reciprocally move between a first position and a second position such that the toy creature moves out of and into the vessel and wherein the lower jaw portion moves towards the upper jaw portion when the toy creature is moving toward the first position and the lower jaw portion moves away from the upper jaw portion when the toy creature is moving towards the second position;

a first track segment and a second track segment disposed proximate to the vessel such that a gap is formed between the first track segment and the second track segment and across the vessel, wherein the toy creature is located at least partially in the gap when the toy creature is in the second position;

a toy vehicle having a thermochromic paint thereon that is configured to travel along the first track segment and the second track segment; and, wherein the toy vehicle traverses the gap when the toy creature is in the first position and the toy vehicle moves from one of the first track segment and the second track segment into the gap, and wherein the toy vehicle is captured by the toy creature when the toy creature is in the second position and the toy vehicle is launched from one of the first track segment and the second track segment into the gap, and wherein the thermochromic paint on the toy vehicle changes from a first color to a second color when the toy vehicle contacts water.

2. The toy vehicle playset of claim 1, wherein the toy vehicle is captured between the upper jaw portion and the lower jaw portion when the toy creature is in the second position and the toy vehicle is launched from one of the first track segment and the second track segment into the gap.

3. The toy vehicle playset of claim 1, wherein the toy vehicle traverses the gap by landing on the second track segment when the toy vehicle is launched from the first track segment and the toy creature is in the first position.

4. The toy vehicle playset of claim 1, wherein the toy creature is completely immersed in the body of water when the toy creature is in the first position and wherein the toy creature is configured to resemble a shark.

5. The toy vehicle playset of claim 1, wherein the lower jaw portion and the upper jaw portion each extend out of the body of water when the toy creature is in the second position and wherein the toy creature is shaped to resemble a piranha.

6. The toy vehicle playset of claim 1, further comprising a tank disposed over a portion of any one of the first track segment, the second track segment or a third track portion coupled to either the first track segment or the second track segment, the tank having a plurality of apertures such that water disposed in the tank is dispersed into the portion.

7. The toy vehicle playset of claim 6, wherein the toy vehicle changes from either the first color to the second color or the second color to the first color when the water dispersed from the tank contacts the toy vehicle.

8. The toy vehicle playset of claim 1, further comprising a toy vehicle launcher configured to launch the toy vehicle such that the toy vehicle traverses at least one of the first track segment and the second track segment.

9. The toy vehicle playset of claim 1, wherein the second track segment further comprises an enclosed tubular track segment leading downwardly away from the vessel.

10. The toy vehicle playset of claim 1, wherein a portion of the first track segment includes an enclosed tubular portion that extends into the vessel.

11. The toy vehicle playset of claim 1, wherein the vessel comprises a base and a translucent tubular shaped side wall coupled to the base, the base and the translucent tubular shaped side wall defining an interior region for receipt of the body of water therein.

12. The toy vehicle playset of claim 1, wherein the toy creature is reciprocally moved between the first position and the second position by a mechanical drive mechanism.

13. The toy vehicle playset of claim 1, wherein the vessel is defined by a translucent wall.

14. A method of changing a color of an object having a thermochromic paint disposed on the object, the method comprising:

launching the object from a first track segment across a gap towards a second track segment, the second track segment being spaced from the first track segment;

capturing the object when it is in the gap by a toy creature; and, lowering the captured object and the toy creature into a body of water disposed below the gap, wherein the thermochromic paint disposed on the object changes from a first color to a second color when the object is immersed in the body of water.

15. The method as in claim 14, wherein the object is a toy vehicle.

16. The method as in claim 14, wherein the toy creature has upper and lower jaw portions that capture the object.

17. The method as in claim 14, wherein, wherein the second track segment further comprises an enclosed tubular track segment leading downwardly away from the body of water.

18. The method as in claim 14, wherein a portion of the first track segment includes an enclosed tubular portion that extends into the body of water.

19. The method as in claim 14, wherein the body of water is retained in a vessel comprising a base and a translucent tubular shaped side wall coupled to the base, the base and the translucent tubular shaped side wall defining an interior region for receipt of the body of water therein.

20. A toy vehicle playset, comprising:

a vessel configured to hold a body of water therein;

first and second track segments disposed proximate to the vessel such that a gap is formed between the first and second track segments and across the vessel;

a toy creature disposed in the vessel, wherein the toy creature is configured to move between a first position and a second position such that the toy creature moves out of and into the vessel and wherein the a portion of the toy creature is disposed in the gap when the toy creature is in the second position;

a toy vehicle having a thermochromic paint thereon that is configured to travel along the first and second track segments; and, wherein the toy vehicle traverses the gap when the toy creature is in the first position and the toy vehicle is launched from one of the first and second track segments into the gap, and wherein the toy vehicle is captured by the toy creature when the toy creature is in the second position when the toy vehicle is launched from one of the first and second track segments into the gap, and wherein the thermochromic paint on the toy vehicle changes from a first color to a second color when the toy vehicle is lowered into the body of water by the toy creature.

* * * * *